United States Patent [19]

Nakama

[11] Patent Number: 4,544,191

[45] Date of Patent: Oct. 1, 1985

[54] LOCKING LATCH FOR LID

[75] Inventor: Daiji Nakama, Chigasaki, Japan

[73] Assignee: Nifco, Inc., Yokohama, Japan

[21] Appl. No.: 659,511

[22] Filed: Oct. 11, 1984

Related U.S. Application Data

[63] Continuation of Ser. No. 613,757, May 24, 1984, abandoned, which is a continuation of Ser. No. 335,043, Dec. 28, 1981, abandoned.

[30] Foreign Application Priority Data

Jan. 12, 1981 [JP] Japan ..... 56-1644[U]

[51] Int. Cl.[4] ..... B65D 55/14

[52] U.S. Cl. ..... 292/341.15; 70/160; 292/87; 292/341.12; 292/DIG. 38; 292/DIG. 72

[58] Field of Search ..... 292/341.15, 80, 19, 292/87-89, 300, 303, 318, 322, 341.12, 341.13, 341.17, DIG. 16, DIG. 38, DIG. 72, 340; 70/159-162; 411/508, 509

[56] References Cited

U.S. PATENT DOCUMENTS

| | | | |
|---|---|---|---|
| 1,131,206 | 3/1915 | Button | 292/19 |
| 2,833,583 | 5/1958 | Stone et al. | 292/340 |
| 3,313,564 | 4/1967 | Pultz | 292/87 |
| 3,811,719 | 5/1974 | McBurnie et al. | 292/341.17 X |
| 3,946,460 | 3/1976 | Johnson | 292/341.17 X |
| 4,109,950 | 8/1978 | Amdal | 292/DIG. 72 X |
| 4,138,151 | 2/1979 | Nakao | 242/341.15 X |
| 4,159,592 | 7/1979 | Gabriel | 411/508 X |

FOREIGN PATENT DOCUMENTS

| | | | |
|---|---|---|---|
| 897065 | 11/1953 | Fed. Rep. of Germany | 292/341.13 |
| 2363154 | 8/1974 | Fed. Rep. of Germany | 292/87 |
| 2830415 | 1/1979 | Fed. Rep. of Germany | 411/508 |
| 2121853 | 3/1979 | Fed. Rep. of Germany | 292/87 |
| 388500 | 3/1933 | United Kingdom | 292/341.17 |

*Primary Examiner*—Gary L. Smith
*Assistant Examiner*—Russell W. Illich
*Attorney, Agent, or Firm*—Trexler, Bushnell & Wolters, Ltd.

[57] ABSTRACT

A plastic one-piece latch for locking a lid comprises a base provided on the underside thereof with a fastener leg, an engaging piece extending from one end of the base and bent abruptly in an oblique upward direction in a manner folded over itself and adapted to make fast engagement with a hook on the lid, and a compression piece extending from the base to a great enough length to collide into the inner surface of the lid at the time that the lid is on the verge of complete closure.

3 Claims, 8 Drawing Figures

LOCKING LATCH FOR LID

This application is a continuation of application Ser. No. 613,757, filed May 24, 1984, now abandoned, which is a continuation of application Ser. No. 335,043, filed Dec. 28, 1981, now abandoned.

BACKGROUND OF THE INVENTION

This invention relates to a plastic one-piece latch particularly suitable for retaining in a closed state a lid serving to close a fuel inlet as in an automobile.

As is widely known, a lid is swingably attached through the medium of a hinge to the fuel inlet of an automobile. This lid is provided at the free end thereof with a bolt which has a hook raised from the leading end thereof and which is disposed in a direction such that when the lid is set in position to close the fuel inlet, the bolt thrusts into the fuel inlet. When the lid is closed after a refill of fuel, the hook on the bolt snaps into engagement with the latch which is prOvided on the interior of the free edge of the fuel inlet. Once this engagement is established, the lid remains fast on the fuel inlet and protects the fuel in the fuel tank from being stolen. It will not open unless and until the bolt is rotated around its axis with a special key. The conventional latch of this principle is a shaped article obtained by bending a metallic leaf spring in the general shape of the letter U. One of the two straight legs of the U-shaped body of the latch is fastened to an edge of the fuel inlet and the other straight leg is used as an engaging piece such that when the lid is being brought to its closed position, it is gradually pressed down by the pressure exerted by the hook of the bolt which slides thereon and, at the time that the lid is completely closed on the fuel inlet, the tip of the hook snaps into engagement with the free end of the engaging piece.

Since this latch is made of a metal, it rusts after prolonged use. Not infrequently, it may be corroded even to the point where it becomes no longer serviceable and requires replacement. Further since the latch is made of a thin metallic leaf spring and is fastened in a protruding manner to the edge of the fuel inlet, there is a fair possibility that the attendant at a filling station, while inserting a fuel nozzle into the fuel inlet through the open lid for the purpose of refilling the fuel tank, will accidentally scratch his fingers on the latch.

Further owing to the error involved in the fabrication and assemblage of the bolt and the latch, the position at which the hook on the bolt and the edge of the latch come into engagement at the time of the closure of the lid may be displaced, though slightly, in the direction of the depth of the fuel inlet In extreme cases, such displacement may cause the hook to fail to snap into engagement with the latch at the time that the lid is completely closed on the fuel inlet or the hook may snap into engagement with the latch before the lid is completely closed; In such a case, the lid may clatter against the fuel inlet, necessitating some measure for eliminating the displacement. Moreover, since the peripheral edge of the fuel inlet is exposed from the outer shell of the automobile, it is coated with the same paint as the outer shell. The edge of the fuel inlet, therefore, must be protected so that its coated surface will not be damaged when the lid is opened and closed. If the coated surface should be scratched or otherwise damaged, the inlet will eventually rust through. As a combined measure for precluding the positional displacement and the infliction of damage, there has heretofore been adopted a practice of fastening rubber pieces at several points on the outer edge of the lid, i.e. at points such that the rubber pieces will come into contact with the coated surface of the peripheral edge of the fuel inlet when the lid is completely closed on the fuel inlet. These rubber pieces protect the coated surface against otherwise possible infliction of damage by the outer edge of the lid. They further serve the purpose of absorbing any dimensional error by causing the hook to snap into engagement with the latch after the rubber pieces have been compressed to a certain extent under the pressure exerted by the lid. The conventional lid, therefore, has been required to be provided in advance with claws for holding such rubber pieces fast in position for effectively fulfilling the purposes mentioned above. It further requires provision of screws for fastening the latch to the fuel inlet.

SUMMARY OF THE INVENTION

With a view to eliminating the problems mentioned above, this invention provides a plastic one-piece latch having integrally incorporated therein, a fastener leg adapted for fast attachment of the latch to the fuel inlet. By virtue of the elasticity of the plastic material thereof, the latch enables the hook on the bolt to be safely engaged therewith within the range of the dimensional error in fabrication without requiring use of any rubber cushion. In spite of its elasticity, the latch is so constructed that it offers ample resistance to prevent a would-be gasoline thief from prying open the lid without use of a special key.

To accomplish the object described above according to the present invention, there is provided a plastic one-piece latch which comprises a base provided on the underside thereof with a fastener leg, an engaging piece disposed at one end of the base and extended slightly outwardly and subsequently turned abruptly in a diagonal upward direction in a manner to be folded back on itself, and a compression piece disposed at the outermost end of the engaging piece and projected to a great enough length to be compressed under the pressure exerted by the lid when the lid has approached the fuel inlet and almost completely closed.

The latch is secured in position by having the fastener leg inserted into a matched hole bored in the edge of the fuel inlet on an automobile. After filling the fuel tank, the lid is closed. At the time that the lid is almost completely closed, the compression piece is struck by the inner surface of the lid. When the lid is further pushed in against the resistance of the compression piece, the hook on the lid snaps into fast engagement with the engaging piece. Once this engagement is established, the lid will not clatter because the compression piece remains energized in the direction of opening the lid. Since the outer edge of the lid is slightly separated from the peripheral edge of the fuel inlet, there is no possibility of its inflicting damage upon the coated surface of the fuel inlet. Further since this latch is extrusion molded in one shot from a plastic material, it is suitable for mass production and proves to be economical.

The other objects and characteristics of the present invention will become apparent from the further disclosure of the invention to be made below with reference to the accompanying drawing.

DESCRIPTION OF PREFERRED EMBODIMENTS

Figure 1:
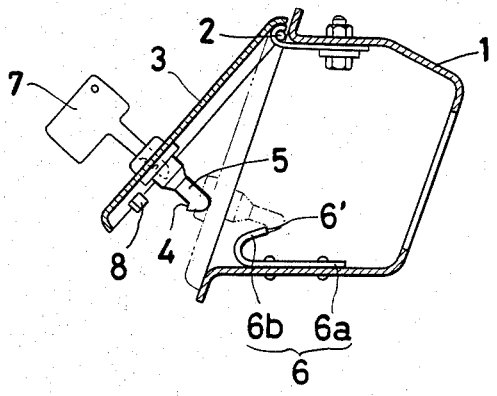
Fig 1 (PRIOR ART)
FIG. 1 is a longitudinal cross section illustrating a typical manner in which a conventional latch is used.
Figure 2:
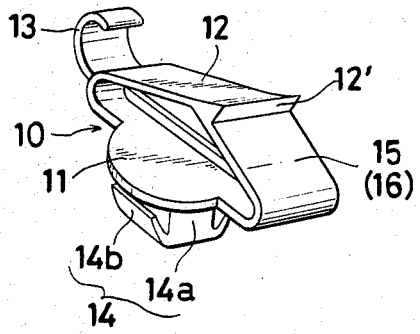
FIG. 2 is a perspective view illustrating an embodiment of the latch according to this invention.

FIG. 1 is an explanatory diagram illustrating the manner in which a conventional latch is closed and opened. To a fuel inlet 1 of an automobile, a lid 3 is swingably attached through the medium of a hinge 2. Along the free edge of this lid, a locking bolt 5 provided at the leading end thereof with a pawl-like hook 4 is disposed in the direction of the depth of the fuel inlet. When the lid is closed as after a refill of fuel at a filling station, the hook 4 on the locking bolt is brought into engagement with a latch 6 fastened to the inside at the outer end of the fuel inlet. Once this engagement is established, the lid remains shut and prevents the gasoline in the fuel tank from being stolen. It is opened when a key 7 for the automobile is inserted into a keyhole in the lid and then turned to give an angular rotation to the locking bolt 5 to allow the hook 4 to be separated from the latch 6. This latch 6 of the conventional principle is a shaped article obtained by bending a metallic leaf spring in the shape of the letter U. One of the two straight legs of the U-shaped body of the latch is attached fast as a fastening piece 6*a* to the outer edge of the fuel inlet and the other straight leg is used as a resilient engaging piece 6*b*. When the lid is brought down toward its closed position, the engaging piece 6*b* is gradually bent down under the pressure exerted by the hook of the locking bolt being slid thereon. At the time that the lid is completely closed, the hook 4 slides past the leading end 6', with the result that the resilience of the engaging piece 6*b* pushes the leading end 6' into unreturnable engagement with the hook 4.

Since the latch is made of a thin metallic leaf, it has the various disadvantages mentioned above, i.e., heavy corrosion after prolonged use, infliction of injuries upon the user's fingers, and instability of the lid despite its complete closure.

One embodiment of the latch according to the present invention will be described below with reference to FIGS. 2–6.

The latch 10 of this invention comprises in combination a plate-like base 11, an engaging piece 12 extended slightly from one end of the base and subsequently bent abruptly in an oblique upward direction in a manner to be folded over itself, a compression piece 13 projecting from the vicinity of one end of the base to great enough length to be pushed back under the pressure exerted by the lid at the time that the lid is almost completely closed, and a fastener leg 14 projecting from the underside of the base. This latch is molded of a plastic material possessing suitable elasticity.

Figure 3:
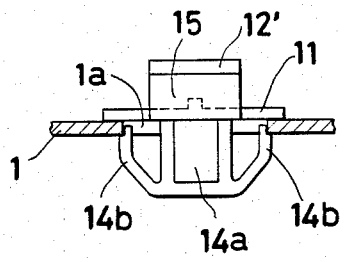
FIG. 3 is a front view illustrating the manner in which the latch of FIG. 2 is fastened in position.
Figure 4:
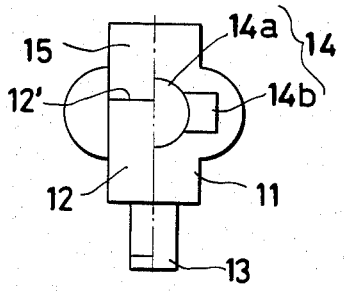
FIG. 4 is a plan view, one half of which represents a top view of the latch of FIG. 2 and the other half a bottom view thereof.

In the illustrated embodiment, the fastener leg 14 is of a well-known anchor type, consisting of a shank 14*a* projecting perpendicularly from the center of the underside of the base and engaging legs 14*b* raised aslant upwardly from the opposite sides of the lower end of the shank. Into a fitting hole la bored in advance in a panel such as the edge of the fuel inlet 1, this latch is inserted outwardly from the inside of the fuel inlet. When this insertion terminates and the lower surface of the base consequently comes into contact with the inner surface of the fuel inlet, the free ends of the engaging legs 14*b* are secured to the rear side of the edge of the fitting hole 1*a* (FIG. 3). It should be noted that the fastener leg is not necessarily limited to the anchor type described above. It may be of some other type insofar as it can be fastened unrotatably to the fitting hole 1*a*.

Figure 5:
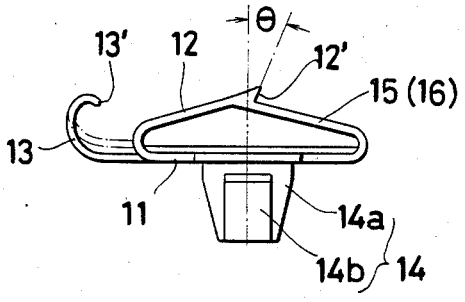
FIG. 5 is a side view of the latch of FIG. 2.

In the present embodiment, the latch is additionally provided with an auxiliary piece 15 extended from the other end of the base 11 and subsequently turned abruptly in an oblique upward direction in a manner to be folded over itself. The leading ends of the auxiliary piece 15 and the engaging piece 12 continue into each other except at a portion 12' at the leading end of the engaging piece 12. The portion 12' of the leading end of the engaging piece which extends beyond the continuity of the two pieces 12, 15 is intended for engagement with the hook on the locking bolt. This portion 12', therefore, is desired to be given a slanted surface which falls practically perpendicularly to the auxiliary piece 15 and forms an angle $\theta$ with the plane perpendicularly intersecting the base (FIG. 5).

When the lid is closed and the hook on the locking bolt is consequently engaged with the latch, the auxiliary piece 15 serves as a means 16 for retaining the established engagement by offering enough resistance to foil any attempt to pry open the lid, as will be described more fully afterward.

Figure 6:
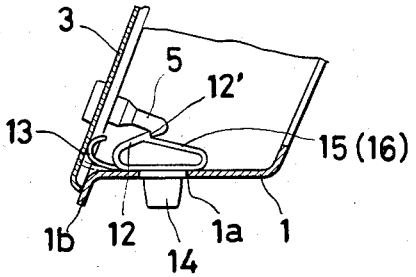
FIG. 6 is an explanatory diagram illustrating the manner in which the latch of FIG. 2 is put to use.

The latch is secured in position along the outer edge on the inner surface of the fuel inlet by means of the fastener leg 14 in such a pOsture that the end thereof having the engaging piece 12 and the compression piece 13 faces the outside of the fuel inlet as illustrated in FIG. 6. The size of the compression piece 13 is so selected that when the latch is held in the posture described above, the leading end of the compression piece 13 protrudes from the position which the inner surface of the lid will assume when the lid is completely closed. As the lid is brought down toward the position of its complete closure, the hook on the locking bolt slides on the engaging piece 12 and pushes down the engaging piece 12. Just before the lid closes completely, the leading end of the compression piece 13 hits the oncoming inner surface of the lid. The lid thereafter has to be pushed in against the resistance offered by the compression piece 13. When the hook slides past the leading end 12' of the engaging piece 12, the engaging piece 12 elastically regains its original shape and causes the leading end 12' to be engaged with the hook. In this state, the compression piece 13 presses the lid in its opening direction and prevents the lid from clattering. Since the outer edge of the lid is slightly separated from the peripheral edge 1*b* of the fuel inlet, there is no possibility of its inflicting damage upon the coated surface of the edge. An effort to pry open the lid will fail because the engaging piece 12 continues into the retaining means 16, namely the auxiliary piece extended from the opposite direction, except at the portion of the leading end of the engaging piece 12 and, consequently, this auxiliary piece prevents the engaging piece 12 from being drawn toward the lid by the external force.

Figure 7:
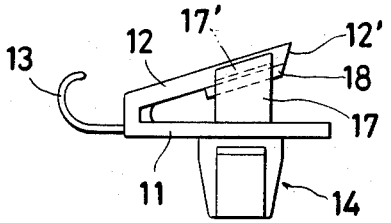
FIG. 7 is a side view illustrating another embodiment of the latch according to this invention.
Figure 8:
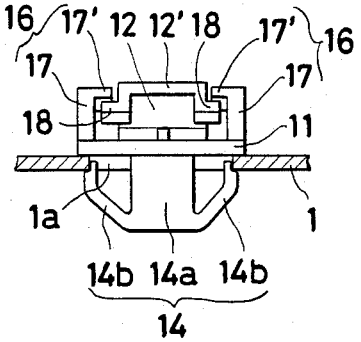
FIG. 8 is a front view of the latch of FIG. 7.

FIG. 7 and FIG. 8 represent another embodiment of the latch according to the present invention. Similarly to the first embodiment, this embodiment is also a one-piece latch formed of a plastic material. It comprises a base 11, an engaging piece 12 extending from one end of the base in an oblique upward direction in a manner folded over itself, a compression piece 13 projecting from the neighborhood of one end of the base, and a fastener leg 14. The main point in which the present embodiment differs from the first embodiment is that the leading end 12' of the engaging piece 12 constitutes a free end and the latch lacks the auxiliary piece which, in the first embodiment, serves to prevent the engaging piece from being bent when an external force is applied to open the lid. Instead, the present latch is provided with a pair of pillars rising from the upper surface of the base 11 along the lateral portions of the leading end of the engaging piece 12. The pillars 17 are provided at their upper ends one each with projections 17' thrusting over the leading end of the engaging piece 12. When an external force exerted to pry open the lid tends to pull up the engaging piece 12, the projections 17' stand in the way to prevent the engaging piece from being pulled up. In the present embodiment, therefore, the pillars 17 provided with the projections 17' serve as means 16 for retaining the established engagement between the hook on the locking bolt and the latch.

The pillars 17 do not interfere with the movement of the hook while the lid is being opened or closed because they are positioned at the opposite lateral sides of the leading end of the engaging piece. Further, in the present embodiment, extended pieces 18 thrust out in the shape of steps from the opposite lateral sides of the leading end of the engaging piece and pass partly under the projections 17'. The upper ends of the pillars and the upper surfaces of the projections 17' substantially fall flush with the upper surface of the engaging piece 12. The movement of the hook, therefore, is perfectly safe from obstruction.

As is clear from the description given above, the latch of the present invention is molded in one piece of a plastic material and therefore, unlike the conventional latch which is made of a metallic leaf spring, has no possibility of inflicting injuries upon the fingers. Optionally, all the edges and corners can be rounded in molding to ensure perfect elimination of danger. Moreover, since the latch is provided with the fastener leg, it can be fastened to the fuel inlet without requiring use of screws. Since it also incorporates the compression piece, it eliminates the need to provide rubber pieces for the lid. Particularly owing to the retaining means 16, the elasticity peculiar to the plastic material enables the hook to press down the engaging piece very lightly and permits the closure of the lid to be effected with great smoothness. Once the lid is completely closed, the retaining means foils any attempt to pry open the lid without use of a special key.

The statement that the compression piece 13 extends from the neighborhood of one end of the base is meant to imply that this extension is not required to be at one end of the base but may be at the base of the engaging piece 12 at the point where this piece is bent abruptly in an oblique upward direction in a manner folded over itself as indicated by the chain line in FIG. 5. This compression piece 13 is not limited to the type having a free end 13' of the shape of a curled tail as illustrated. Optionally, the leading end of the compression piece may continue into the engaging piece.

What is claimed is:

1. A one-piece latch molded of resilient plastic material comprising a substantially flat imperforate base adapted to be mounted against a supporting surface, fastener leg means integral with and extending from the underside of said base and adapted to snap resiliently in place in an aperture in said supporting surface to mount said base flat against said surface, a resilient retaining member integral with and extending in coplanar relation with said base from an edge of said base in a first direction and folded back over itself and said base at an acute angle and extending substantially oppositely of said leg means and outwardly away from said base, said retaining member having engaging edge portion at an extremity of said latch adapted to engage a hook portion of a locking bolt, an integral resilient compression piece extending in said first direction beyond said retaining member and having a folded over reentrant end portion adapted resiliently to engage the inner surface of a lid carrying said locking bolt to support said lid in anti-rattle condition spaced closely from said supporting surface, and integral retaining means extending from said base substantially opposite to said retaining member substantially coplanar with said base and folded back over itself and said base at an acute angle and outwardly of said base and integrally joined to said retaining member adjacent said engaging edge portion for aid in positioning said edge portion, said base, said retaining member, and said retaining means in outline comprising substantially a triangle.

2. A latch as set forth in claim 1 wherein said compression piece is substantially coplanar with said base irrespective of said end portion, and is deflected from such coplanar relation by engagement of the reentrant end portion with a lid.

3. A one-piece latch molded of resilient plastic material comprising a substantially flat imperforate base adapted to be mounted against a supporting surface, fastener leg means integral with and extending from the underside of said base and adapted to snap resiliently in place in an aperture in said supporting surface to mount said base flat against said surface, a resilient retaining member integral with and extending in coplanar relation with said base from and edge of said base in a first direction and folded back over itself and said base at an acute angle and extending substantially oppositely of said leg means and outwardly away from said base, said retaining member having an engaging edge portion at an extremity of said latch adapted to engage a hook portion of a locking bolt, and integral retaining means extending from said base substantially opposite to said retaining member substantially coplanar with said base and folded back over itself and said base at an acute angle and outwardly of said base and integrally joined to said retaining member adjacent said engaging edge portion for aid in positioning said edge portion, said base, said retaining member, and said retaining means being integral and in outline comprising substantially a hollow triangle having an apex, said retaining member and said retaining means being resilient, said edge portion being adjacent said apex.

* * * * *